United States Patent [19]

Dickhart, III

[11] 4,454,821

[45] Jun. 19, 1984

[54] RADIAL ARTICULATED TRUCK

[75] Inventor: William W. Dickhart, III, Fort Washington, Pa.

[73] Assignee: The Budd Company, Troy, Mich.

[21] Appl. No.: 317,305

[22] Filed: Nov. 2, 1981

[51] Int. Cl.[3] ..... B61D 3/10; B61F 3/12; B61F 5/44

[52] U.S. Cl. ..... 105/4 R; 105/168; 105/199 R

[58] Field of Search ..... 105/3, 4 R, 176, 167, 105/168, 182 R, 199 R

[56] References Cited

U.S. PATENT DOCUMENTS

| | | | |
|---|---|---|---|
| 638,665 | 12/1899 | Green | 105/176 |
| 2,846,954 | 8/1958 | Gaynor | 105/4 R |
| 2,936,720 | 5/1960 | VanAlstine | 105/4 R |
| 4,289,075 | 9/1981 | Smith | 105/168 |

FOREIGN PATENT DOCUMENTS

| | | | |
|---|---|---|---|
| 552538 | 1/1932 | Fed. Rep. of Germany | 105/4 R |
| 939934 | 3/1956 | Fed. Rep. of Germany | 105/4 R |
| 454352 | 1/1950 | Italy | 105/4 R |
| 1120160 | 7/1968 | United Kingdom | 105/4 R |

*Primary Examiner*—Robert B. Reeves
*Assistant Examiner*—Howard Beltran
*Attorney, Agent, or Firm*—Edward M. Farrell; Herman Foster; Thomas I. Davenport

[57] ABSTRACT

An articulated truck joins and supports two adjacent railway cars. A linkage including two pairs of links is connected between the bolster of the truck and one of the railway cars. A common link is connected between the two pairs of link. The linkage and common link forces the truck to maintain a radial position with respect to curves in the track.

1 Claim, 5 Drawing Figures

FIG. 4
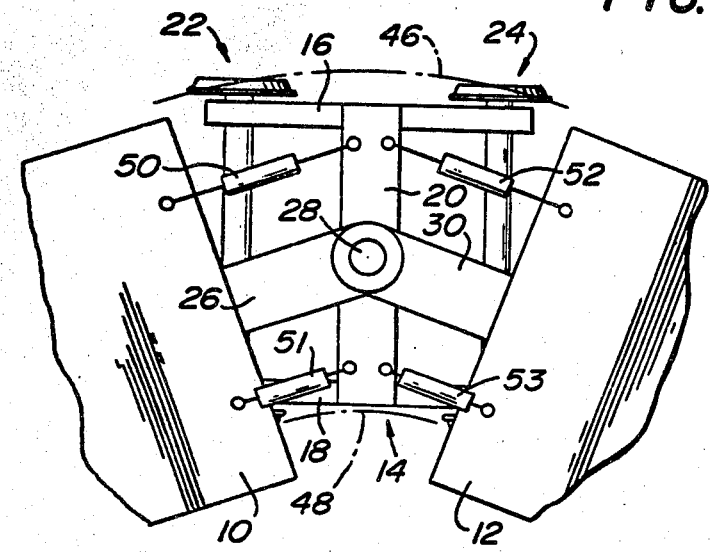
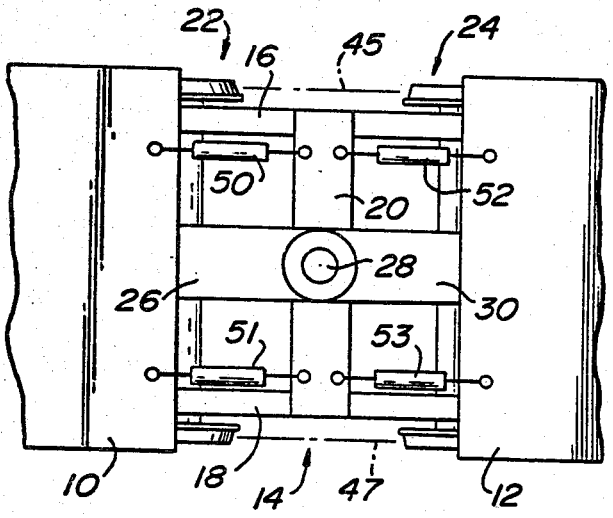
FIG. 5

RADIAL ARTICULATED TRUCK

BACKGROUND OF THE INVENTION

In copending applications entitled "Railway Hopper Car", Ser No. 473,371, filed Mar. 8, 1983, which is a continuation of application Ser. No. 236,861, filed Feb. 23, 1981, now abandoned and "A Low Level Freight Car for Carrying Trailers", Ser No. 434,294, filed Oct. 14, 1982, which is a continuation of application Ser. No. 147,965, filed May 8, 1980, now abandoned, both of which are assigned to the same assignee as the present invention, there is described a hopper car in which a pair of adjacent units of the car are connected by a single truck. A coupler between the units and the truck provide articulation therebetween. The coupler includes conventional male and female connector elements connected to the same center pin to permit the adjacent units to swivel about a common point on the truck. The coupler assists in inhibiting rock and roll movement and reduces slack run out between the units.

The articulated units using a coupler of the type mentioned in the aforementioned application has some effect in reducing the curving forces on the wheels during curves. However, when left to the coupler alone, the arrangement sometimes results in a high angle of attack between the lead outer wheel and the rail. This causes wheel wear and has other undesirable results.

The use of forced steering to reduce wheel flange wear, rail gauge wear, wheel/rail noise and energy consumption when a rail car is negotiating a turn is known. One such forced steering system is described in a copending application entitled "An Articulated Truck Assembly", Ser. No. 306,156, filed Sept. 28, 1981, also assigned to the same assignee as the present invention.

It is desirable to provide an articulated truck designed to join and support adjacent rail cars or units while still offering the advantages of forced steering for the truck.

OBJECTS OF THE INVENTION

It is an object of this invention to provide an improved articulated truck for joining and supporting two adjacent railway cars.

It is a further object of this invention to provide an improved articulated truck for joining and supporting two adjacent railway cars in which the truck is forced to take a radial position with respect to a curved track to thereby minimize the high angle of attack between the outer lead wheel of the truck and the rail of the track.

BRIEF SUMMARY OF THE INVENTION

In accordance with the present invention, an articulated truck including wheel and axle assemblies is disposed to join and support two rail car units. When the truck is negotiating a curve in the track, forced steering elements become operative to force the truck to take a radial position with respect to the curved track. The elements may include a lever system or spring arrangement.

Other objects and advantages of the present invention will be apparent and suggest themselves to those skilled in the art, from a reading of the following specification and claims, taken in conjunction with the accompanying drawings.

BRIEF DESCRIPTION OF THE DRAWINGS

FIGS. 4 and 5 are views similar to FIGS. 2 and 3, respectively, wherein spring units are employed as the forced steering elements.

DETAILED DESCRIPTION OF THE INVENTION

Figure 1:
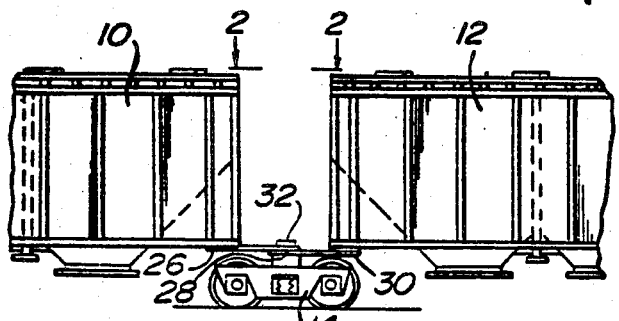
FIG. 1 is a side view with a truck joining and supporting two rail car units, in accordance with the present invention.

Referring to FIG. 1, a pair of adjacent hopper car units 10 and 12 are supported at their inner ends by a truck 14. The opposite ends of the car units (not illustrated) may be connected in a similar manner to other units in the train. The opposite ends of the train would generally include a conventional truck for support on one end of the end car units which is not linked to an adjacent car unit.

Figure 2:
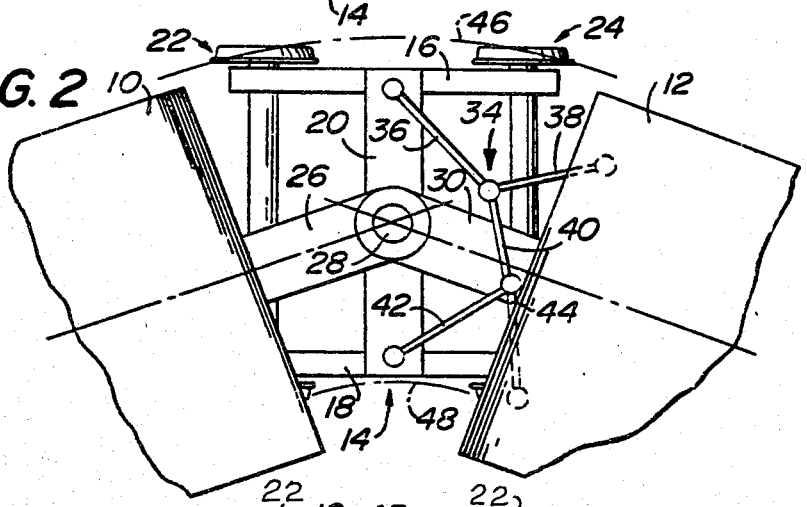
FIG. 2 illustrates the car units negotiating a curve in a track in which lever elements are used for forced steering.
Figure 3:
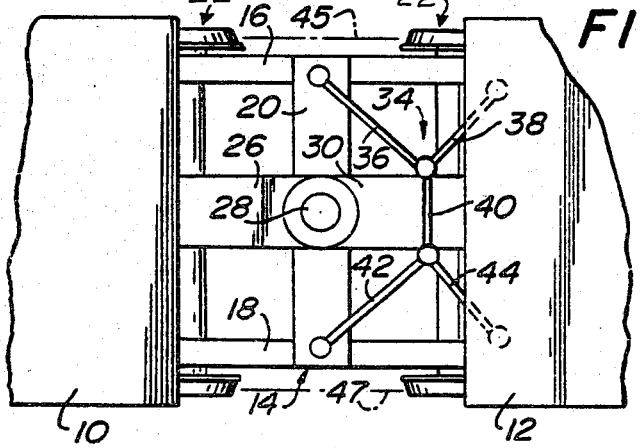
FIG. 3 is a view, somewhat similar to FIG. 2, illustrating the car units on a straight track.

Referring to FIGS. 2 and 3, the truck 14 includes a pair of side frames 16 and 18 for supporting a bolster 20. A pair of wheel axle assemblies 22 and 24 are attached to the side frames in a conventional manner.

A connecting plate 26 is fixed to one end of the car unit 10 and pivotally connected to move about a pin 28 which is fixed to the center of the bolster 20. In like manner, a plate 30 is fixed at one end of the car unit 12 and connected to pivot about the pin 28. The plates 26 and 30 are held on the pin 28 by suitable means such as a top plate 32. The coupler arrangement illustrated may be of the type which include conventional male and female connector elements connected to the same center pin. While the details are not illustrated, a type of coupler which may be used in an articulated connector of a type manufactured by American Steel Foundries, 1005 Prudential Plaza, Chicago, Illinois 60601.

Forced steering means to assist in the steering of the truck 14 is provided when the car units 12 and 14 go around a curved track. In FIGS. 2 and 3, the forced steering means includes a lever arrangement 34 to keep the bolster 20 radial with respect to curved rails of the track. The lever arrangement 34 includes a linkage including five bars 36, 38, 40, 42 and 44.

Bar 36 is connected from one end of the bolster 20 to one end of the bar 40 and the bar 38. The opposite end of the bar 38 is connected to the end of the car unit 12. The bar 42 is connected from the other end of the bolster 20 to the opposite end of the bar 40 and the bar 44. The opposite end of the bar 44 is connected to the end of the car unit 12.

The connections of the bars 38 and 44 to the car unit 12 are laterally spaced with respect to each other towards opposite sides on the bottom of the car unit 12. The car unit 12 controls the steering of the truck 14. FIG. 3 illustrates the lever arrangement 34 in a normal condition when the cars 10 and 12 are moving along a straight track over rails 45 and 47. The bars 36 and 38 form the same angle as the bars 42 and 44. The connecting bar 40 is substantially parallel with the bolster 20.

On straight tracks, the bars 36 and 38 are at substantially right angles with respect to each other. Likewise, on straight tracks the bars 42 and 44 are substantially perpendicular with respect to each other.

During movement over a track curving in one direction, the car units 10 and 12 assume angular positions with respect to each other and the bars of the lever arrangement 34 assume positions illustrated in FIG. 2 and force the truck 14 to maintain a substantially radial position with the curved rails 46 and 48.

When the car units 10 and 12 encounter curves in the tracks as illustrated, the bars 36 and 38 are moved to increase the angle therebetween causing the distance between the connections on the bolster 20 and car unit 12 to increase. At the same time the angle between the bars 42 and 44 decreases. Because of the connecting bar 40, the sum of the two angles between the bars, 36, 38 and bars 42, 44 remain the same, with one angle increasing inversely with the decreasing of the other angle. The connecting bar 40 forces each pair of oppositely connected bars to follow the inverse movement of the other pair of bars.

The overall result is that the truck 14 tends to move laterally one way or the other to maintain a radial position with respect to the track. The bars employed must be of sufficient length to accommodate the maximum curves to be encountered by the car units in the train.

Basically, the bolster 20 is maintained radial to the tracks. When the car units encounter curves, one end of the bolster is forced to move in one direction with the opposite end being forced to move in the opposite direction a corresponding distance to maintain the radial position of the bolster.

Referring to FIGS. 4 and 5, similar reference numerals to FIGS. 3 and 4 are used for similar parts.

A pair of spring units 50 and 52 are connected between the ends of the car units 10 and 12, respectively, and one end of the bolster 20. A second pair of spring units 51 and 53 are connected between the ends of the car units 10 and 12 and the opposite end of bolster 20. The springs 50 and 52 are connected on the same sides of the car units 10 and 12 with the spring units 51 and 53 being connected on opposite sides of the car units.

The functions of the units 50, 51 52 and 53 are to assist in the steering for the truck 14 by maintaining the bolster 20 radial to the rails of the track during operation. The spring units 50, 51, 52 and 53 have the same expansion and contraction characteristics. When curves in a track are encountered, as in FIG. 4, the springs 50 and 52 expand while the springs 51 and 53 contract. During normal operation, all of the spring units are under some tension. This condition is illustrated in FIG. 5.

When the car units 10 and 12 go around curved tracks, the normal reaction of the truck 14 is to take a radial position with respect to the overall track. When this occurs, the spring units 50 and 52 expand and the spring units 51 and 53 contract and tend to assist and provide some steering. In FIG. 4, the units 50 and 52 will tend to maintain equal and opposite forces on one end of the bolster 20. At the same time, the spring units 51 and 52 contract equal amounts.

When the car units 10 and 12 are negotiating a curve in an opposite direction to that illustrated in FIG. 4, the springs 51 and 53 expand while the springs 50 and 52 contact to maintain the bolster 20 radial with the track.

What is claimed is:

1. In combination with a truck for connecting and supporting a pair of linked rail cars and having a bolster connected to a pair of side frames with wheel axle assemblies on said side frames, a forced steering system for maintaining said truck substantially radial with respect to a curved track during operation comprising:

(a) connecting means secured to said bolster;

(b) means for pivotally connecting the ends of said rail cars to said connecting means;

(c) a mechanical linkage including a plurality of bars connected between one of said rail cars and said bolster to force said truck to maintain a radial position with said curved track;

(d) said plurality of bars comprise two pairs of bars connected between the opposite ends of said bolster to laterally spaced connections of said one of said rail cars, and a connecting bar connecting said two pairs of bars; and (e) said two pairs of bars forcing the opposite ends of said bolster to be moved in opposite directions relative to the end of said one car when said truck is passing over a curved track.

* * * * *